US006308463B1

(12) United States Patent
Bennett

(10) Patent No.: US 6,308,463 B1
(45) Date of Patent: Oct. 30, 2001

(54) HINGE ASSEMBLY AND METHOD OF ATTACHMENT FOR COMPOSITE PANEL DOORS

(75) Inventor: Timothy J. Bennett, Springfield, MO (US)

(73) Assignee: The Maiman Company, Springfield, MO (US)

( * ) Notice: Subject to any disclaimer, the term of this patent is extended or adjusted under 35 U.S.C. 154(b) by 0 days.

(21) Appl. No.: 09/551,128

(22) Filed: Apr. 18, 2000

(51) Int. Cl.[7] ..... E04C 2/54

(52) U.S. Cl. ..... 49/501; 52/784.14; 52/784.13

(58) Field of Search ..... 49/501, 381; 52/784.13, 52/784.14, 784.15, 793.1, 485, 798.1, 784.1; 411/55, 80.1, 80.5, 80.6

(56) References Cited

U.S. PATENT DOCUMENTS

| | | | | |
|---|---|---|---|---|
| 550,314 | * | 11/1895 | Adams | 411/80.5 |
| 697,896 | * | 4/1902 | Smith | 411/80.5 |
| 777,134 | * | 12/1904 | Palmer | 411/80.5 |
| 3,750,333 | * | 8/1973 | Vance | 49/501 |
| 3,950,894 | * | 4/1976 | DiMaio | 49/501 |
| 3,987,588 | * | 10/1976 | Imperial et al. | 49/501 |
| 4,084,347 | * | 4/1978 | Brown | 49/397 |
| 4,148,157 | * | 4/1979 | Franc | 49/501 |
| 4,281,479 | * | 8/1981 | Daus | 49/503 |
| 4,573,287 | * | 3/1986 | Hagemeyer et al. | 49/381 |
| 4,789,285 | * | 12/1988 | Fischer | 411/32 |
| 4,888,918 | * | 12/1989 | Green et al. | 49/501 |
| 4,955,675 | * | 9/1990 | Donaghy | 312/214 |
| 5,103,528 | * | 4/1992 | Olson et al. | 16/2 |
| 5,318,734 | * | 6/1994 | Palmersten et al. | 264/46.5 |
| 5,743,057 | * | 4/1998 | Martin | 52/457 |
| 5,775,041 | * | 7/1998 | Tull et al. | 52/455 |
| 5,782,055 | * | 7/1998 | Crittenden | 52/784.1 |
| 5,887,402 | * | 3/1999 | Ruggie et al. | 52/455 |
| 5,950,382 | * | 9/1999 | Martino | 52/311.1 |
| 6,138,341 | * | 10/2000 | Barroero et al. | 29/527.1 |
| 6,185,894 | * | 2/2001 | Sisco et al. | 52/457 |

* cited by examiner

*Primary Examiner*—Alvin Chin-Shue
*Assistant Examiner*—Curtis A. Cohen
(74) *Attorney, Agent, or Firm*—Shook, Hardy & Bacon L.L.P.

(57) ABSTRACT

A door having a core made from a composite panel material such as medium density fiberboard or particleboard is provided with a plurality of dowels which are secured, such as by an adhesive, within openings extending into the core. The dowels and openings are positioned in alignment with the screw holes in the hinges which mount the door to a jamb or cabinet. Screws or other fasteners extend through the screw openings in the hinges and are secured within the dowels. The dowels permit conventional wood screws to be used to mount the hinges to the door and improve the screw holding capability of the door. The dowels also eliminate the need to use edge banding for screw holding purposes and thereby eliminate the problems associated with the joint formed between the edge banding and the core material.

31 Claims, 1 Drawing Sheet

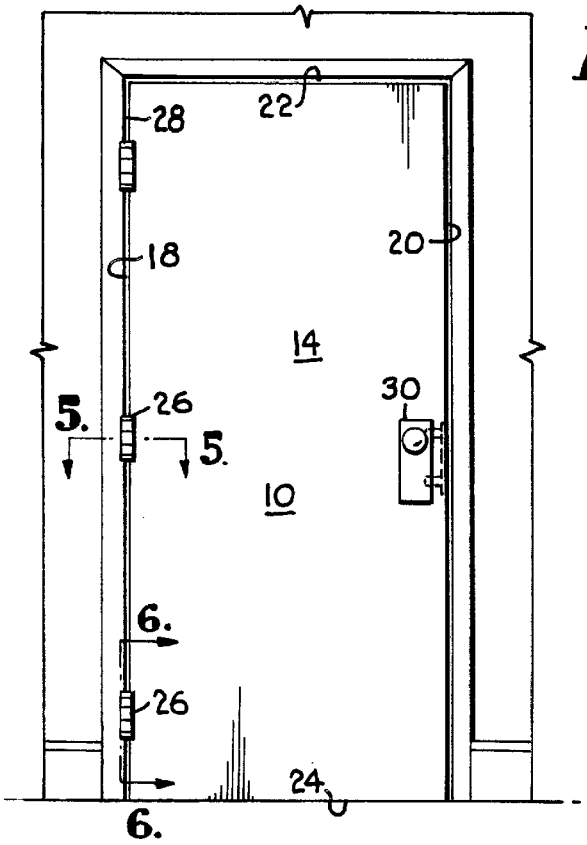
FIG. 1.
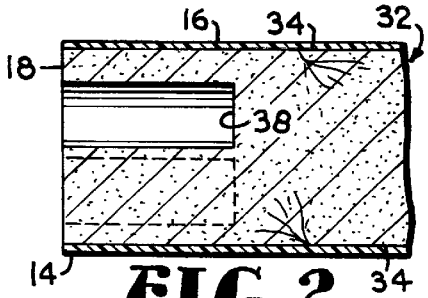
FIG. 2.
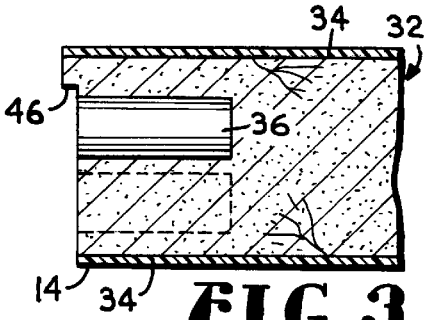
FIG. 3.
FIG. 4.
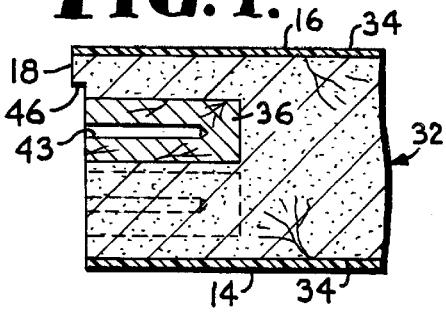
FIG. 6.
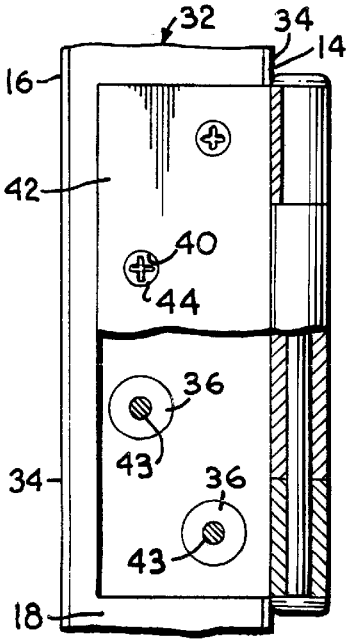
FIG. 5.
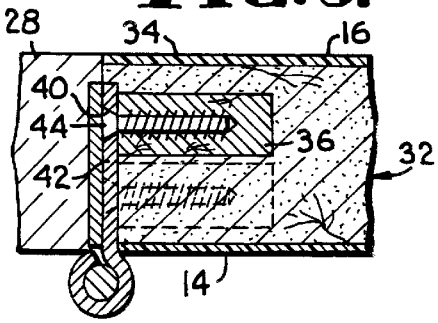

HINGE ASSEMBLY AND METHOD OF ATTACHMENT FOR COMPOSITE PANEL DOORS

BACKGROUND OF THE INVENTION

The present invention relates to composite panel doors and, more particularly, to a hinge assembly used to mount the door within a frame, as well as a method of securing the hinge assembly to the door.

Medium density fiberboard is a composite panel product that typically comprises lignocellulosic fibers combined with a synthetic resin or other suitable bonding systems under heat and pressure. Four standard grades of medium density fiberboard are commercially available in North America and are classified under ANSI Standard A208.2 based on product density and other physical and mechanical properties.

Medium density fiberboard is widely used in the manufacture of furniture products because it provides a flat, smooth surface that can be precisely machined and easily finished. The use of medium density fiberboard for cabinet and passage doors is particularly desirable because of its smoothness, insulating properties and resistance to warping. One problem associated with doors constructed from medium density fiberboard is that the screw holding capacity of the fiberboard material may be less than desired in many applications. As a result, manufacturers recommend that specially sized pilot holes be used and that single thread parallel core screws be used in place of traditional wood screws to secure the hinges to the fiberboard material. These special requirements may present problems for installers who are unaware of the requirements or who do not have access to the recommended type of specialty screws in a finish that matches the hinge.

An alternative to the use of specialty screws to mount the hinges directly to the medium density fiberboard material is the use of wood edge banding along at least the hinge side of the door to present a wood surface which can securely retain conventional wood screws and provide the strength needed to withstand the loads experienced by the hinges. Edge banding, however, can add significantly to the cost of the door because of the need for additional equipment, material and production steps to install the edge banding. The joint between the edge banding and the fiberboard core material is aesthetically undesirable and often requires the use of a panel known as a "crossband" which extends from top to bottom and from side to side on the door to hide the edge banding joint and prevent it from "telegraphing" through the overlying veneer. The crossband further adds to the cost of the door and does not always completely hide the underlying joint.

Another approach to improving the screw holding capability of composite panel doors involves the use of a wedge-shaped strip of wood which is inserted into a groove cut from the top to bottom of the door along the hinge side of the door. Because the groove is formed only in the side of the door, no joint is formed along either face of the door and the use of a crossband is unnecessary. There is still, however, the problem of telegraphing of the joint along the side of the door when a veneer or other coating is applied to the door. The wedge-shaped wood may have different moisture absorption properties than the core material and may cause warping of the door.

A need thus exist for a method and apparatus to increase the screw holding and hinge loading capacity of a composite panel door without causing the disadvantages resulting from conventional approaches.

SUMMARY OF THE INVENTION

In one aspect, the present invention is directed to a door having at least a core made from a composite panel material such as any of the various grades of medium density fiberboard or particleboard and at least one dowel inserted into a pre-drilled opening in the core. The opening is positioned at a location corresponding to a hinge used to support the door and the dowel is secured within the opening by any of various types of adhesives. The dowel preferably comprises a hardwood, but may be formed from other materials having sufficient screw holding properties. A screw is threadably inserted into the dowel through a hole in a leaf of the hinge to secure the hinge to the door. If desired, a pilot hole may be first drilled into the dowel to facilitate insertion of the screw into the dowel. The other leaf of the hinge is then secured to the door jamb or other mounting surface in a conventional fashion.

In another aspect, the invention is directed to a method of securing a hinge to a composite panel door of the type described above. The method includes the steps of drilling one or more dowel-receiving openings into the core of the door at a location corresponding to the intended location of the door-supporting hinge. A dowel is then inserted into each opening and an adhesive is used to secure the dowel against withdrawal or turning movement. An optional screw pilot hole may be drilled into the dowel prior to or after insertion of the dowel into the opening. Once the adhesive has securely bonded the dowel in the opening, a leaf of the hinge is placed against the door and a screw is inserted through an opening in the leaf and is turned into the dowel to secure the leaf to the dowel. In many applications, a plurality of dowels are utilized for each of the two or more to hinges that support the door.

A primary advantage of the present invention is the dowels increase the screw holding capacity of the door by an unexpected amount without the need to use edge banding with its attendant problems of telegraphing of the joint between the edge banding and core material. Notably, the dowels are hidden beneath the hinges, resulting in a more desirable visual appearance for the door. Because the dowels can be formed from wood, conventional wood screws may be used to secure the hinge to the door, thereby eliminating the need to use specialty screws and special pilot holes.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a fragmentary elevation view of a door constructed in accordance with the present invention positioned at an opening in a wall;

FIGS. 2–5 are fragmentary top plan views of the door taken in horizontal section and illustrating in sequence the placement of dowels in the door, morticing of the hinge cutout, drilling of the screw pilot holes and fastening the hinge to the door; and FIG. 6 is a fragmentary end elevation view of the door taken along line 6—6 in FIG. 1 and showing a hinge with various portions broken away for purposes of illustration.

DESCRIPTION OF THE PREFERRED EMBODIMENT

Referring now to the drawings in greater detail and initially to FIG. 1, a door constructed in accordance with the present invention is designated broadly by the numeral 10 and is shown mounted within an opening in a wall 12. The door 10 is of a flat panel or flush construction and has opposed faces 14 and 16 (FIG. 6), opposed sides 18 and 20, and a top 22 and bottom 24. A plurality of hinges 26 mount the door 10 to a jamb 28 and a passage set or lockset 30 is provided to facilitate opening and closing of the door.

Door 10 has a core 32 made from a composite panel material, preferably a type of composite panel material that lacks the screw holding capacity necessary to withstand the loads and stresses experienced by the door, particularly during repeated opening and closing of the door. As used herein, "composite panel material" is intended to refer to any of the various types of materials prepared in mat form, typically under heat and pressure, from wood fibers, chips and the like and a resin or other bonding material. Medium density fiberboard in its various grades, including those classified by ANSI Standard A208.2, is an example of a composite panel material having particular applicability in connection with the present invention. Particleboard, including those grades classified in ANSI Standard A208.1, is another, less preferred, example of a composite panel material with which the present invention is useful. It is to be understood, however, that the invention can have applicability to other types of composite panel materials.

Normally, the core 32 will be covered on one or both faces 14 and 16, as well as the sides 18 and 20 and top 22 and bottom 24, with a facing material 34 such as wood veneer, high pressure laminate, vinyl, foil, coatings of paint or other materials providing the desired texture or appearance. In some applications, it may be desirable for the door to have an unfinished appearance and in such applications a clear coating such as polyurethane or varnish may be applied to the core 32. Alternatively, the facing material 34 may be omitted from the core 32 entirely and the use of the term "core" herein is not meant to exclude such a possibility. Although the door 10 is illustrated with a flush construction, lights and any desired pattern may be provided in the faces 14 and 16 of the door 10. As one example, one or both of the door faces 14 and 16 may be formed to provide a stile and rail appearance.

The features of the door 10 described above are of a conventional nature. Turning now to FIGS. 2–6, in accordance with the present invention, the screw holding capacity of the door can be increased by the use of dowels 36 secured within the core 32 at the locations of hinge 26. The dowels 36 are inserted within openings 38 that have been formed in the core 32 such as by drilling into the core 32 from one face or from the side 18 of the door, depending upon the placement of the hinges on the door. The dowel-receiving openings 38 are preferably drilled to a depth corresponding to the length of the dowel and are of a diameter to tightly receive the dowel. The openings 38 and dowels 36 are preferably aligned with each screw hole 40 in a leaf 42 of each hinge 26 which is to be secured to the door 10. In some applications, however, it may be desirable to use dowels at less than all of the hinge screw holes 40. The number of hinges 26 used with the door 10, as well as their spacing and positioning on the sides or faces of the door, can be varied to suit the particular application.

The dowels 36 are typically of cylindrical shape and can be formed of any suitable material having the desired screw holding capability. Hardwoods, such as birch, are particularly well suited materials for use as dowels 36. The dowels are secured within the openings 38 in core 32 using an bonding agent such as an adhesive that is compatible with both the dowel and core materials and is capable of securely retaining the dowel 36 within the opening 38. Polyvinyl acetate wood glue is one example of a preferred adhesive when birch is the selected material for the dowels and medium density fiberboard is the selected core material. The dowels 36 may include grooves formed in the outer surface to facilitate application of the adhesive and insertion of the dowel into the opening.

The hinge leafs 42 are secured by fasteners 44 which extend through the screw holes 40 in the leafs and penetrate into the dowels 36. Collectively, the hinge leafs 42, dowels 36 and fasteners 44 form a hinge assembly which provides the appearance of a conventional hinge because the dowels 36 are hidden beneath the hinge leafs 42. The fasteners 44 serve the function of securing the hinge leafs 42 to the dowels 36 and this can be accomplished in any suitable way. The fasteners 44 will typically be wood screws, but other types of fasteners can be used, such as nails or the single thread, parallel core specialty screws normally used with medium density fiberboard. The size of the fasteners 44 should be selected to withstand the loads experienced by the door and the length of the fasteners 44 and the dowels 36 will normally be roughly the same. When wood screws are utilized as the fasteners 44, the dowel 36 should have a diameter greater than the screw shank and will normally have a diameter two or more times greater than the screw shank. As can be seen in FIG. 4, a pilot hole 43 is normally drilled longitudinally into each dowel 36 prior to turning the screw fasteners 44 into the dowel. The pilot hole 43 can be drilled either prior to or after insertion of the dowel 36 into the opening 38.

A cutout 46 can be mortised into the side of the door at the hinge location to permit the hinge leaf 42 to lay flush. The cutout 46 can be formed before or after insertion of the dowels 36 into openings 38.

Although the invention has been described and illustrated with reference to a passage-type door, it is to be understood that the invention may be readily applied to other types of doors such as cabinet doors. It will also be appreciated that different types of hinges may be utilized, including those that are mounted to the face rather than the edge of the door. In such applications, the dowel will be inserted into the face rather than the edge of the door.

A series of test were conducted in order to determine the screw holding capacity of the doors constructed in accordance with the present invention for comparison to published test results for the same core material. The test were conducted in accordance with test standard TM-10, Screw Capacity Test, published by the National Wood Window and Door Association and effective Apr. 15, 1990. The dowels used in the test were spiral grooved, birch lumber, 0.5 inch in diameter and 1.5 inches in length. Polyvinyl acetate wood glue was used to secure the dowels within the openings in the core material. The core materials utilized were 42 $lb/ft^3$ and 28 $lb/ft^3$ medium density fiberboard manufactured by Dominance Industries, Inc. of Broken Bow, Okla. and sold under the trademarks Megaboard™ and Megacore™, respectively. The test results are set forth in the following table and demonstrate an unexpectedly large increase in screw holding capability when the screws are anchored in the dowels rather than the core materials.

TABLE

| Material | Test Method | Lb. of Force Required to Withdraw Screw |
|---|---|---|
| 42 lb. MDF w/o dowels | Door face | 275 |
| 42 lb. MDF w/dowels | Door face | 865 |
| 28 lb. MDF w/o dowels | Door face | 125 |
| 28 lb. MDF w/dowels | Door face | 839 |
| 42 lb. MDF w/o dowels | Door side | 300 |
| 42 lb. MDF w/dowels | Door side | 933 |
| 28 lb. MDF w/o dowels | Door side | 125 |
| 28 lb. MDF w/dowels | Door side | 480 |

It will be appreciated that the present invention eliminates the need for using edge bands and can significantly reduce the costs associated with manufacture of doors containing a core of composite panel material. Notably, there is no visual evidence of the dowels 36 once the hinge leafs 42 have been applied to the door 10, thereby allowing veneer or another type of coating to be applied to the sides 18 and 20 of the door, as well as the faces 14 and 16 and top 22 and bottom 24, without the telegraphing problem associated with conventional doors.

From the foregoing it will be seen that this invention is one well adapted to attain all ends and objects hereinabove set forth together with the other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A door comprising:

a core comprising a composite panel material and having opposed faces and sides and a top and a bottom;

at least one opening extending into the composite panel material in said core;

a dowel secured within said opening; and at least one hinge secured to said core by at least one fastener coupled with said hinge and extending into and secured within said dowel.

2. The door as set forth in claim 1, wherein said composite panel material is medium density fiberboard or particleboard.

3. The door as set forth in claim 1, wherein said composite panel material is medium density fiberboard.

4. The door as set forth in claim 3, including at least two of said hinges secured to said core by at least two of said fasteners.

5. The door as set forth in claim 4, wherein said fastener is a screw.

6. The door as set forth in claim 5, wherein said dowel is a wood.

7. The door as set forth in claim 5, wherein said hinge has a leaf and said screw extends through said leaf.

8. The door as set forth in claim 4, including a facing applied to one or both faces of said core.

9. The door as set forth in claim 8, including a facing material applied to one or both faces of said core.

10. The door as set forth in claim 9, wherein said facing material is selected from the group consisting of coatings, veneer, laminate, vinyl and foil.

11. The door as set forth in claim 9, including an adhesive securing said dowel within said opening.

12. The door as set forth in claim 9, including a plurality of said openings each having one of said dowels secured therein and wherein each of said dowels has one of said fasteners secured therein.

13. A method of securing a hinge to a door having a core formed of a composite panel material, comprising the steps of:

forming at least one opening extending into said core of composite panel material;

securing a dowel within said opening; and attaching a hinge to said core by coupling a fastener with said hinge and securing said fastener within said dowel.

14. The method as set forth in claim 13, including the step of drilling to form said opening extending into the core.

15. The method as set forth in claim 13, including the step of using an adhesive to secure said dowel within said opening.

16. The method as set forth in claim 15, wherein the step of securing the fastener within the dowel comprises the step of turning a screw into the dowel.

17. The method as set forth in claim 16, including the step of forming a pilot hole in the dowel prior to turning the screw into the dowel.

18. A door comprising:

a core comprising a composite panel material and having opposed faces and sides and a top and a bottom;

at least one opening extending into composite panel material in said core;

a dowel secured within said opening;

at least one hinge; and means for securing said hinge within said dowel.

19. The door as set forth in claim 18, wherein said composite panel material is medium density fiberboard.

20. The door as set forth in claim 18, including means securing said dowel within said opening.

21. The door as set forth in claim 18, including a plurality of said openings each having one of said dowels secured therein and wherein each of said dowels has one of said means secured therein.

22. A door comprising:

a core comprising a medium density fiberboard and having opposed faces and sides and a top and a bottom;

at least one opening extending into the medium density fiberboard in said core;

a dowel secured within said opening; and at least one hinge having a leaf and secured to said core by at least one screw extending through an opening in said leaf and secured within said dowel.

23. The door as set forth in claim 22, wherein said dowel is a wood.

24. The door as set forth in claim 22, including a facing material applied to one or both faces of said core and selected from the group consisting of coatings, veneer, laminate, vinyl and foil.

25. The door as set forth in claim 22, including an adhesive securing said dowel within said opening.

26. The door as set forth in claim 22, including a plurality of said openings each having one of said dowels secured therein and wherein each of said dowels has one of said screws extending through said leaf hinge and secured within said dowel.

27. A door comprising:

a core comprising a particleboard and having opposed faces and sides and a top and a bottom;

at least one opening extending into the particleboard in said core;

a dowel secured within said opening; and at least one hinge having a leaf and secured to said core by at least one screw extending through an opening in said leaf and secured within said dowel.

28. The door as set forth in claim 27, wherein said dowel is a wood.

29. The door as set forth in claim 27, including a facing material applied to one or both faces of said core and selected from the group consisting of coatings, veneer, laminate, vinyl and foil.

30. The door as set forth in claim 27, including an adhesive securing said dowel within said opening.

31. The door as set forth in claim 27, including a plurality of said openings each having one of said dowels secured therein and wherein each of said dowels has one of said screws extending through said leaf hinge and secured within said dowel.

* * * * *